US005233849A

United States Patent [19]

Forbers

[11] Patent Number: 5,233,849

[45] Date of Patent: Aug. 10, 1993

[54] REMOTE KEY ACTUATOR FOR VEHICLE TRUNK LOCK

[75] Inventor: Anthony G. Forbers, Detroit, Mich.

[73] Assignee: General Motors Corporation, Detroit, Mich.

[21] Appl. No.: 944,471

[22] Filed: Sep. 14, 1992

[51] Int. Cl.[5] ..... E05B 65/19

[52] U.S. Cl. ..... 70/256; 70/461; 292/125; 292/225; 292/DIG. 25; 292/DIG. 29; 292/DIG. 43; 292/DIG. 60

[58] Field of Search ..... 70/256, 257, 461, DIG. 42; 292/28, 38, 50, 84, 125, 133, 141, 171, 225, 235, DIG. 25, DIG. 29, DIG. 43, DIG. 60, DIG. 62

[56] References Cited

U.S. PATENT DOCUMENTS

| | | | |
|---|---|---|---|
| 3,155,408 | 11/1964 | Peras | 292/DIG. 43 X |
| 3,760,617 | 9/1973 | Westerdale | 70/256 X |
| 4,872,366 | 10/1989 | Appleby et al. | 292/DIG. 25 X |
| 4,998,758 | 3/1991 | Kowalczyk et al. | 292/201 |

FOREIGN PATENT DOCUMENTS

| | | | |
|---|---|---|---|
| 0009724 | 1/1984 | Japan | 292/DIG. 25 |

*Primary Examiner*—Lloyd A. Gall
*Attorney, Agent, or Firm*—Charles E. Leahy

[57] ABSTRACT

A remote control latch assembly includes a fork-bolt and detent style latch carried on the moveable deck lid of a vehicle. A key actuator is spaced from the latch and receives a standard key for unlatching the deck lid from a covered position over the trunk compartment. The key actuator includes a frame attached directly to the moveable deck lid, and a rotor supported in the frame and turned by the key. An involute track is formed in the frame having the rotor as its theoretical base cylinder. A core element operatively extends between the rotor and the latch. A conduit guidably surrounds the core element and includes a flange adjacent a terminal end portion thereof slideably received in the involute track. The angular orientation of the conduit is adjusted relative to the key actuator frame without relative lengthwise movement between the core element and the conduit by sliding the flange in the involute track.

4 Claims, 2 Drawing Sheets

REMOTE KEY ACTUATOR FOR VEHICLE TRUNK LOCK

TECHNICAL FIELD

The invention relates to an automobile deck lid latch assembly and more particularly to such an assembly controlled by a key cylinder actuator spaced remotely from the latch assembly.

BACKGROUND ART

Most passenger vehicles are provided with a trunk compartment for the convenient storage and transportation of luggage and other articles. The trunk compartment is covered by a protective deck lid closure member pivotally attached to the vehicle. A latch, such as that of the fork-bolt and detent type well known in the art, is carried on the deck lid, or alternatively fixed to the vehicle, and engages a striker to maintain the deck lid closure in a covered position over the compartment. The latch is actuated to release the deck lid closure from its covered position over the trunk compartment by manipulation of the key cylinder actuator.

In the past, it was most common to orient the key cylinder actuator immediately adjacent the latch so that the key was directly operatively engaged with the latch. However, for technical and aesthetic reasons, is has become popular to locate the key actuator remote from the latch. For this reason, a flexible motion transmitting remote control core element is supported in a protective conduit and connected to each the key actuator and the latch.

U.S. Pat. No. 4,998,758 in the name of Kowalczyk, issued Mar. 12, 1991, and assigned to the assignee of the subject invention, discloses a typical prior art remote control latch assembly with a key actuator mounted remotely of the latch, and a core element and conduit arrangement operatively interconnecting the two. The conduit is integrally supported in a mounting frame of the key actuator to restrain the conduit against lengthwise, i.e., axial, movement.

In such constructions, the fixed relationship between the conduit and the mounting frame of the key actuator may, depending upon the configuration of the deck lid closure, force the conduit to bend in a somewhat tortious path with sharp turns between the key actuator and the latch. It will be readily appreciated that as the conduit is forced around sharp bends, the moving core element will experience increased friction within the conduit. Therefore, an operator in the process of opening the deck lid closure by turning the key in the key actuator must apply additional turning effort to overcome the increased friction caused by the sharply bent conduit. Accordingly, when the conduit is forced around tight turns, it will be more difficult for a person to unlatch the deck lid than if the conduit where routed through gradual, larger radii used, bends.

SUMMARY OF THE INVENTION AND ADVANTAGES

The invention relates to a remote control actuation assembly for a vehicle having a trunk compartment and a moveable deck lid closure. The assembly comprises a latch means for releasing the closure member from a covered position over the compartment in response to a motion input, a remote actuator means spaced from the latch means for generating a motion input to release the latch means, a core element flexibly extending along its length between a control end operatively connected to the actuator means in a distal end operatively connected to the latch means for transmitting motion from the actuator means to the latch means, and a conduit guidably surrounding the core element and having a terminal end portion spaced from the control end to form an exposed length of the core element. The improvement comprises a conduit adjustor means for preventing relative lengthwise movement between the core element and the conduit while adjusting the angular orientation of the terminal end portion relative to the actuator means to maintain the exposed length between the terminal end portion and the control end during angular adjustment of the conduit.

The conduit adjustor means permits rerouting of the conduit to eliminate severe bends in the conduit while at the same time preventing any relative lengthwise, or axial, movement between the core element and the conduit. In this manner, readjustment of the core element relative to the conduit is not required even after the angular orientation of the terminal end portion of the conduit has been adjusted Therefore, the latch assembly of this invention can be incorporated in a number of different vehicle models with the conduit easily adjusted to minimize friction between the core element and the conduit on an individual (per car) basis. The effort required to turn the key in the remote actuator means is thereby decreased to an absolute minimum optimizing the opening of the trunk compartment.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
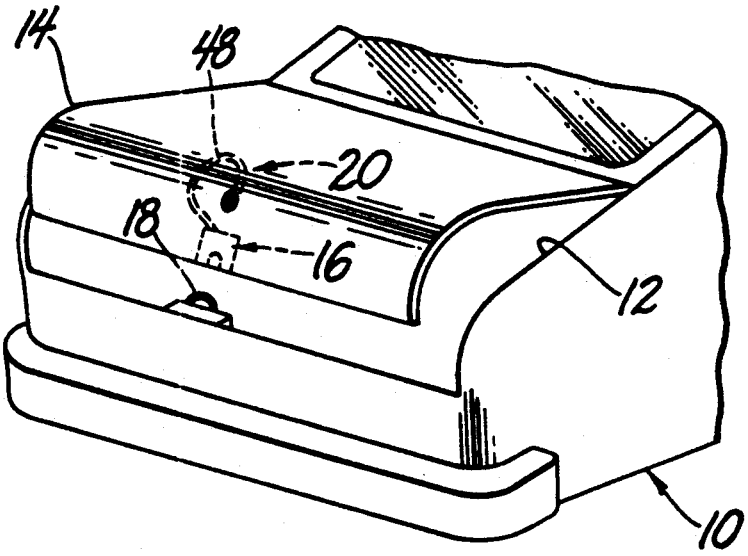
FIG. 1 is a fragmentary perspective view of the rear end of a vehicle having a trunk compartment and a moveable deck lid closure.

Referring to the FIGURES, wherein like numerals indicate like or corresponding parts throughout the several views, the rear end of a vehicle, generally indicated at 10, is shown in FIG. 1. The vehicle 10 includes a trunk compartment 12 and a moveable deck lid closure member 14. The closure member 14 is hinged at its forwardmost edge for pivotal movement between open and covered positions over the trunk compartment 12.

Figure 2:
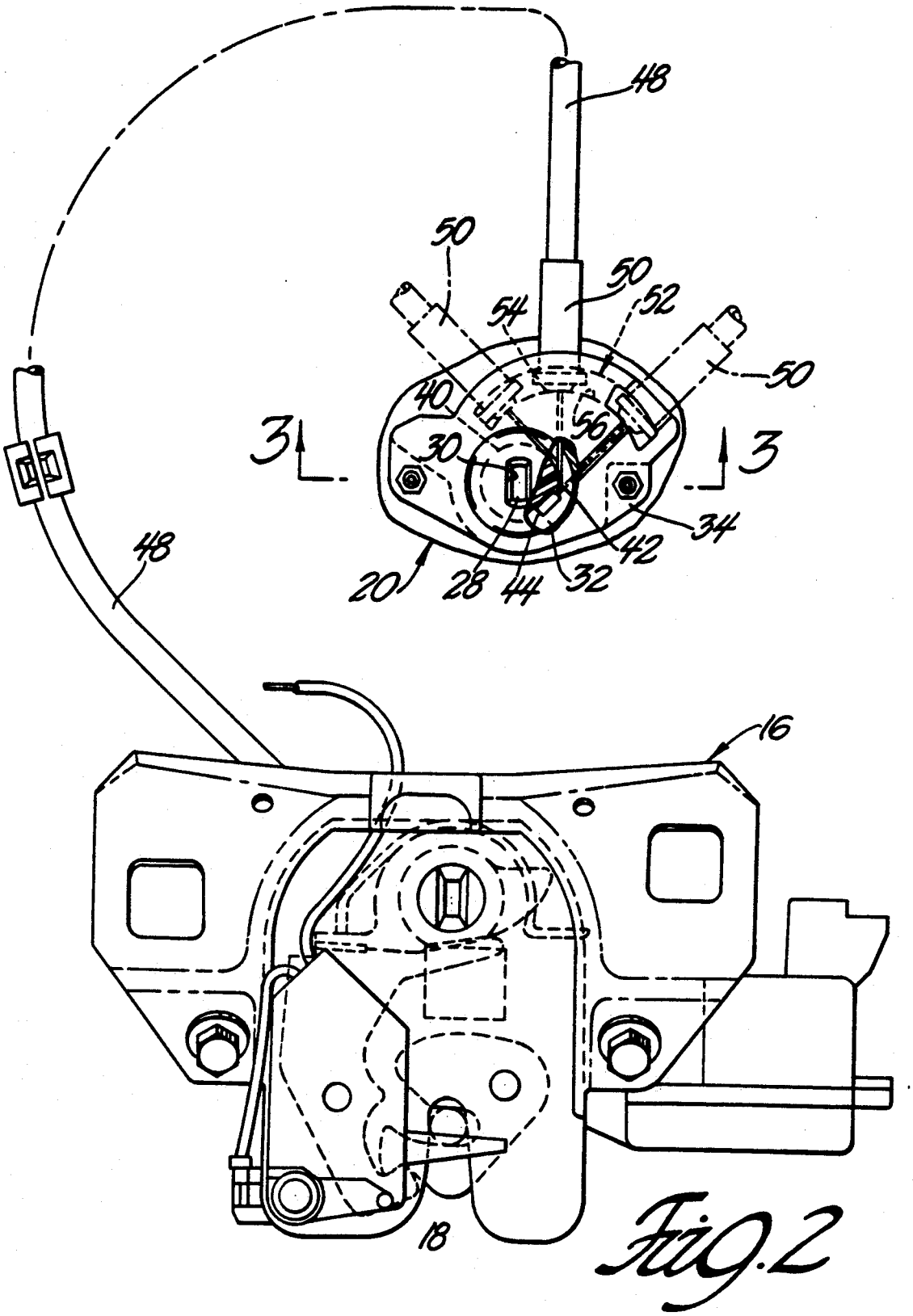
FIG. 2 is a front elevation view of a trunk latch assembly disconnected from the vehicle.

A latch means, generally indicated at 16 in FIGS. 1 and 2, is carried on the interior face of the closure member 14 for releasing the closure member 14 from the covered position over the trunk compartment 12 in response to a motion input. The latch means 16, more specifically, comprises the well known fork-bolt and detent style lock assembly. The latch means 16 engages and holds fast a striker 18 supported on the inside of the trunk compartment 12. The striker 18 is also of the well known type comprising a U-shaped rod positioned to engage the latch means 16 on pivotal movement of the closure member 14 toward the covered position.

Figure 3:
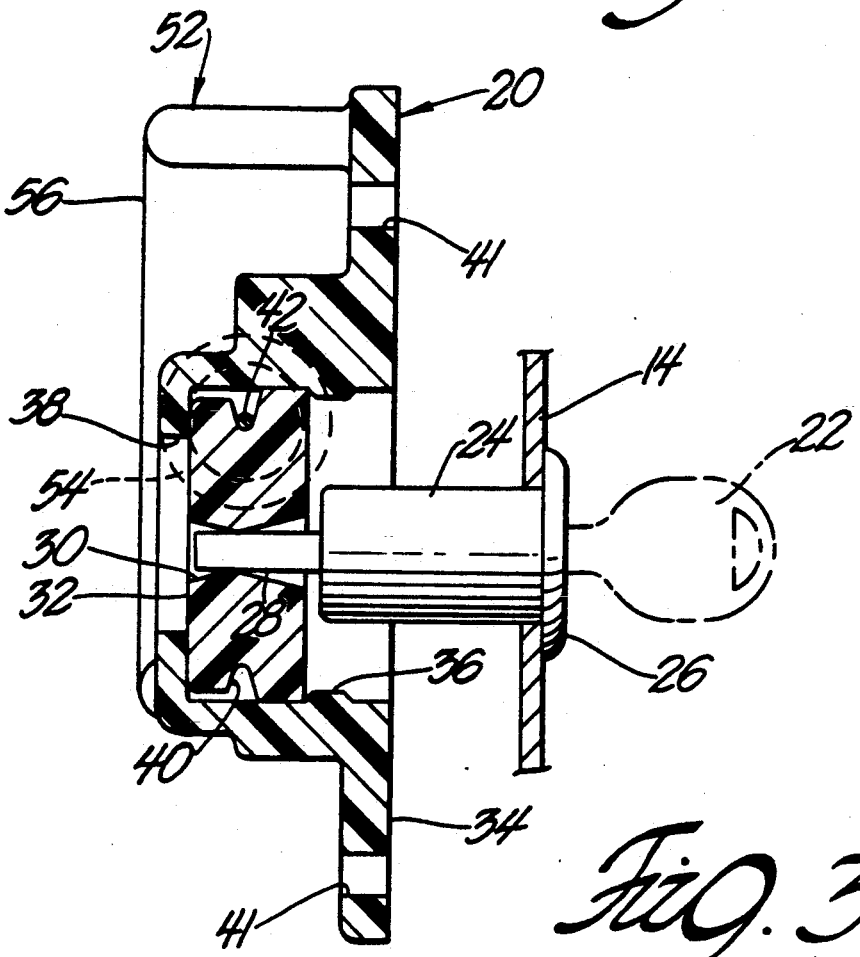
FIG. 3 is a cross-sectional view of the key actuator as taken along lines 3—3 of FIG. 2.

A remote actuator means, generally indicated at 20 in FIGS. 1-3, is spaced from the latch means 16 for generating a motion input to release the latch means 16. The remote actuator means 20 preferably comprises a key actuator of the well known type for receiving a typical automotive lock key 22, as shown in phantom in FIG. 3. The actuator means 20 includes a key cylinder 24 supported through an opening in the closure member 14. The key cylinder 24 includes a flange 26 supported against the sheet metal outer surface of the closure member 14. A tongue 28 extending rearwardly from the key cylinder 24 is rotated by movement of the key 22 in the key cylinder 24.

A rotor 32 includes a rectangular opening 30 operatively receiving the tongue 28. The rotor 32 is a generally annular member supported for rotation in a mounting frame 34. That is, the rotor 32 is freely moveable in the mounting frame 34 and captured therein between an annular abutment 36 and a cover 38. The rotor 32 includes an annular V-shaped groove 40. The frame 34 is provided with two mounting holes 41 that receive fasteners for securing the assembly to the closure member 14.

A flexible motion transmitting core element 42 extends along its length between a control end 44 and a distal end. As best shown in FIG. 2, the control end 44 of the core element 42 is fixedly captured in a pocket of the rotor such that the core element 42 rests within the groove 40. The distal end is operatively connected to the latch means 16 in the typical prior art fashion. For example, reference may be had to U.S. Pat. No. 4,998,758 in the name of Kowalczyk et al, issued Mar. 12, 1991, the disclosure of which is incorporated herein by reference. And, similar to the prior art, the latch means 16 may include additional electronic actuators The core element 42 is situated so as to transmit motion, i.e., tensile forces, from the actuator means 20 to the latch means 16. Therefore, as the rotor 32 is rotated by the key 22 and key cylinder 24, the control end 44 of the control element 42 draws the core element 42 around the groove 40 in a winch-like winding manner. The distal end is displaced a corresponding distance thereby releasing the latch means 16 from the striker 18 to permit opening of the deck lid closure member 14.

A conduit 48 surrounds the core element 42 between the actuator means 20 and the latch means 16 to guide and protect the core element 42. The conduit 48 is of typical tubular construction and fabricated from sufficiently flexible material so as to permit routing of the conduit 48 and core element 42 along the closure member 14. The conduit 48 includes a terminal end portion 50 adjacent the actuator means 20. The terminal end portion 50 is spaced from t he control end 44 of the core element 42 so as to form an exposed length of the core element 42 protected inside the actuator means 20 by the mounting frame 34. In other words, the core element 42 extends outwardly from the terminal end portion 50 of the conduit 48 to the point where the control end 44 is connected to the rotor 32.

A conduit adjustor means, generally indicated at 52 in FIG. 2, is provided for preventing relative lengthwise movement between the core element 42 and the conduit 48 while adjusting the angular orientation of the terminal end portion 50 of the conduit 48 relative to the actuator means 20. The conduit adjustor means 52 maintains the exposed length of the core element 42 between the terminal end portion 50 of the conduit 48 and the control end 44 of the core element 42 during angular adjustment of the conduit 48. Therefore, in order to reduce the effort required to actuate the latch means 16 by the key cylinder 42, the conduit 48 can be reoriented or rerouted in the closure member 14 so as to eliminate severe bends. The conduit adjustor means 52 permits such reorientation of the conduit 48 without moving (axially) the core element 42. Specifically, as shown in FIG. 2, the terminal end portion 50 of the conduit 48 can be shifted laterally through a curvature of approximately 90° without disturbing the control end 44 of the core element 42 seated in the rotor 32

More particularly, the terminal end portion 50 of the conduit 48 is provided with a guide member 54 which, in the preferred embodiment, comprises an annular flange. A track 56 is fixed relative to the actuator means 20 and operatively movably retains the guide member 54 of the conduit 48 in such a manner so as to prevent relative movement of the terminal end portion 50 lengthwise, or axially, of the core element 42.

At least a portion of the track 56 comprises an involute curve. In the preferred embodiment, the entire track 56 extends along an involute curvature having as its theoretical base circle the outer diameter of the groove 40. As is well known, an involute curve is the path generated by a tracing point on a cord as the cord is unwrapped from a cylinder called the base cylinder. Accordingly, the involute track 56 is disposed in a plane extending perpendicular to the rotational axis of the rotor 32.

The involute track 56 guides the terminal end portion 50 of the conduit 48 during angulation of the conduit 48 to eliminate sharp bends as discussed above. The involute track 56 also simultaneously prevents, or restrains, the conduit 48 from moving lengthwise relative to the core element 42 by way of the restrained guide member 54. The involute track 56 and guide member 54 are also effective in enabling the subject latch assembly to be installed either new or retrofit in different vehicles having other deck lid configurations and shapes by removing the sharp bends and tortious paths of the conduit 48. Thus, the effort required to turn the key 22 and the key cylinder 24 is significantly reduced.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A remote control latch assembly for a vehicle having a trunk compartment and a moveable deck lid closure, said assembly comprising: latch means for releasing a closure member from a covered position over a compartment in response to a motion input; remote actuator means spaced from said latch means for generating a motion input to release said latch means; a core element flexibly extending along its length between a control end operatively connected to said actuator means and a distal end operatively connected to said latch means for transmitting motion from said actuator means to said latch means; a conduit guidably surrounding said core element and having a terminal end portion spaced from said control end to form an exposed length of said core element; and conduit adjustor means for preventing relative lengthwise movement between said core element and said conduit while adjusting the angular orientation of said terminal end portion relative to said actuator means to maintain said exposed length between said terminal end portion and said control end during angular adjustment of said conduit.

2. A remote control latch assembly for a vehicle having a trunk compartment and a moveable deck lid closure, said assembly comprising: latch means for releasing a closure member from a covered position over a compartment in response to a motion input; remote actuator means spaced from said latch means for generating a motion input to release said latch means; a core element flexibly extending along its length between a control end operatively connected to said actuator means and a distal end operatively connected to said latch means for transmitting motion from said actuator means to said latch means; a conduit guidably surrounding said core element and having a terminal end portion spaced from said control end to form an exposed length of said core element, said conduit including a guide member adjacent said terminal end portion; and a track fixed relative to said actuator means and operatively movably retaining said guide member for preventing relative lengthwise movement between said core element and said conduit while adjusting the angular orientation of said terminal end portion relative to said actuator means to maintain said exposed length between said terminal end portion and said control end during angular adjustment of said conduit.

3. An assembly as set forth in claim 2 wherein at least a portion of said track comprises an involute curve.

4. A remote control latch assembly for a vehicle having a trunk compartment and a moveable deck lid closure, said assembly comprising: latch means for releasing a closure member from a covered position over a compartment in response to a motion input; a key actuator spaced from said latch means for generating a motion input to release said latch means, said key actuator including a mounting frame and a rotor rotatably supported in said mounting frame; a core element flexibly extending along its length between a control end operatively connected to said rotor and a distal end operatively connected to said latch means for transmitting motion from said rotor to said latch means; a conduit guidably surrounding said core element and having a portion spaced from said control end to form an exposed length of said core element, said conduit including a flange adjacent a terminal end portion; and an involute track integral with said mounting frame and operatively movably retaining said flange for preventing lengthwise movement between said core element and said conduit while adjusting the angular orientation of said terminal end portion relative to said rotor to maintain said exposed length between said terminal end portion and said control end during angular adjustment of said conduit.

* * * * *